US007036398B2

(12) United States Patent
Chen

(10) Patent No.: US 7,036,398 B2
(45) Date of Patent: May 2, 2006

(54) RATCHET OPENER

(76) Inventor: Chang-Ying Chen, 235 Chung-Ho, Box 8-24, Taipei (TW)

( * ) Notice: Subject to any disclaimer, the term of this patent is extended or adjusted under 35 U.S.C. 154(b) by 72 days.

(21) Appl. No.: 10/791,613

(22) Filed: Mar. 3, 2004

(65) Prior Publication Data

US 2005/0193870 A1 Sep. 8, 2005

(51) Int. Cl.
*B25B 13/00* (2006.01)
*B25B 13/46* (2006.01)

(52) U.S. Cl. ..... 81/58.3; 81/58.4; 81/63.1; 81/63.2

(58) Field of Classification Search ..... 81/58.3, 81/58.4, 63.1, 63.2, 60–63; 192/43.2
See application file for complete search history.

(56) References Cited

U.S. PATENT DOCUMENTS 1,474,798 A * 11/1923 Stark ..... 81/63.2
1,512,176 A * 10/1924 Johnson ..... 81/33
6,047,802 A * 4/2000 Huang ..... 192/43.2
6,058,812 A * 5/2000 Casel et al. ..... 81/60
6,622,597 B1 * 9/2003 Chen ..... 81/58.3
2002/0002881 A1 * 1/2002 Glass ..... 81/58.3

* cited by examiner

*Primary Examiner*—Joseph J. Hail, III
*Assistant Examiner*—Bryan Muller

(57) ABSTRACT

A ratchet opener comprises a rod body; a ratchet device having a seat; a top surface of the seat having two axial grooves; each groove being installed with a spring and a ratchet block; an adjusting sheet placed above the seat; and a ratchet sheet being installed above the adjusting sheet. Each ratchet block has a teethed inclined surface; the teeth surfaces of the two ratchet blocks are symmetrical to a center of the seal. A center of the adjusting sheet is installed with a second via hole; and the ratchet block is installed with a non-round buckling hole corresponding to the cylinder at the lower end of the rod body. In use, by controlling the adjusting sheet, the objects of unidirectional, bi-directional, and idle rotations are achieved. The operation is easy.

6 Claims, 5 Drawing Sheets

RATCHET OPENER

FIELD OF THE INVENTION

The present invention relates to openers, and particularly to a ratchet opener, wherein by controlling the adjusting sheet, the objects of unidirectional, bi-directional, and idle rotations are achieved. The operation is easy and convenient.

BACKGROUND OF THE INVENTION

In the prior art, a standard type ratchet opener has a seat installed on a handle. An approximate C shape stopper protrudes from the seat. A receiving space in a center of the stopper receives a tool rod of a ratchet unit. A left and a right stop of the ratchet unit are received in the left and right slots between the stopper and the cylinder. The cylinder has a left projection and a right projection corresponding to the left and right stops for engaging a left and a right concave portion at a rear middle section of the left and right stop. Thereby, the left and right stops swing along the engaging portions, but not to engage a teethed section of the tool rod. Thereby, the seat can drive the tool rod to rotate.

In another prior art, a seat is installed in a handle. A receiving portion at a center of the seat serves to receive a tool rod of a ratchet unit. Two sides of the receiving portion are extended with a left receiving chamber and a right receiving chamber symmetrically for installing the left and right stops of the ratchet unit. The seat has two protrusions for supporting the left and right stops. Thereby, the left and right stops swing along the engaging portions, but not to engage a teethed section of the tool rod. Thereby, the seat can drive the tool rod to rotate.

In above mentioned two prior arts, the left and right stops are used to transversally control the rotation direction of the tool rod. Thereby, the transversal control has the following problems. The components of the ratchet opener are too complicated to be manufactured easily. As a result, the assembly work is difficult and some techniques in assembly must be learned, which increases the burdens of workers. Moreover, since the assembly work is complicated, more workers are necessary. However, this increases the cost.

SUMMARY OF THE INVENTION

Accordingly, the primary object of the present invention is to provide a ratchet opener which comprises a rod body; a lower end of the rod body being protruded with a non-round cylinder; a handle having a receiving chamber; a ratchet device having a seat; a center of the seat being installed with a first via hole; a top surface of the seat having two axial grooves; each groove being installed with a spring and a ratchet block; an adjusting sheet placed above the seat; and a ratchet sheet being installed above the adjusting sheet. Each ratchet block has a teethed inclined surface; the teeth surfaces of the two ratchet blocks are symmetrical to a center of the seal. The adjusting sheet has two through holes which are arranged corresponding to the two ratchet blocks in the seat. A center of the adjusting sheet has a second via hole; and the ratchet block is installed with a non-round buckling hole corresponding to the cylinder at the lower end of the rod body. When the ratchet device is assembled, the rod body will pass through the buckling hole; first via hole and the second via hole and the seat is buckled to the receiving chamber of the handle.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be described in the following in detail. However, these descriptions and the appended drawings are only used to allow those skilled in the art to understand the objects, features, and characteristics of the present invention, but not to be used to confine the scope and spirit of the present invention defined in the appended claims.

Figure 1:
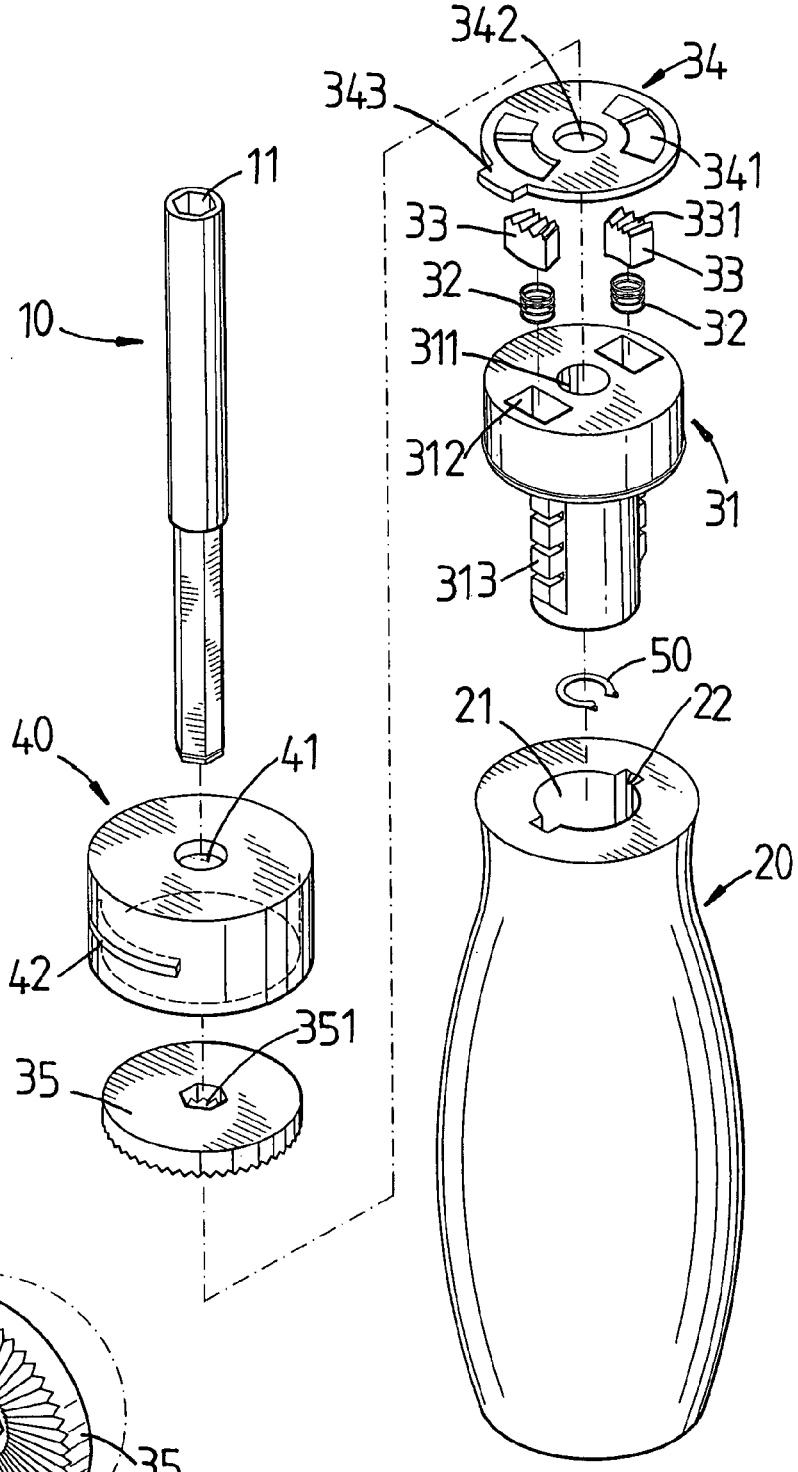
FIG. 1 is a structural schematic view of the ratchet opener of the present invention.
Figure 2:
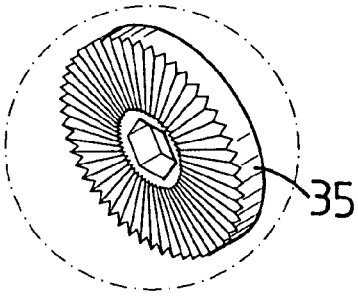
FIG. 2 is a schematic view of the ratchet sheet of the ratchet opener of the present invention.
Figure 3:
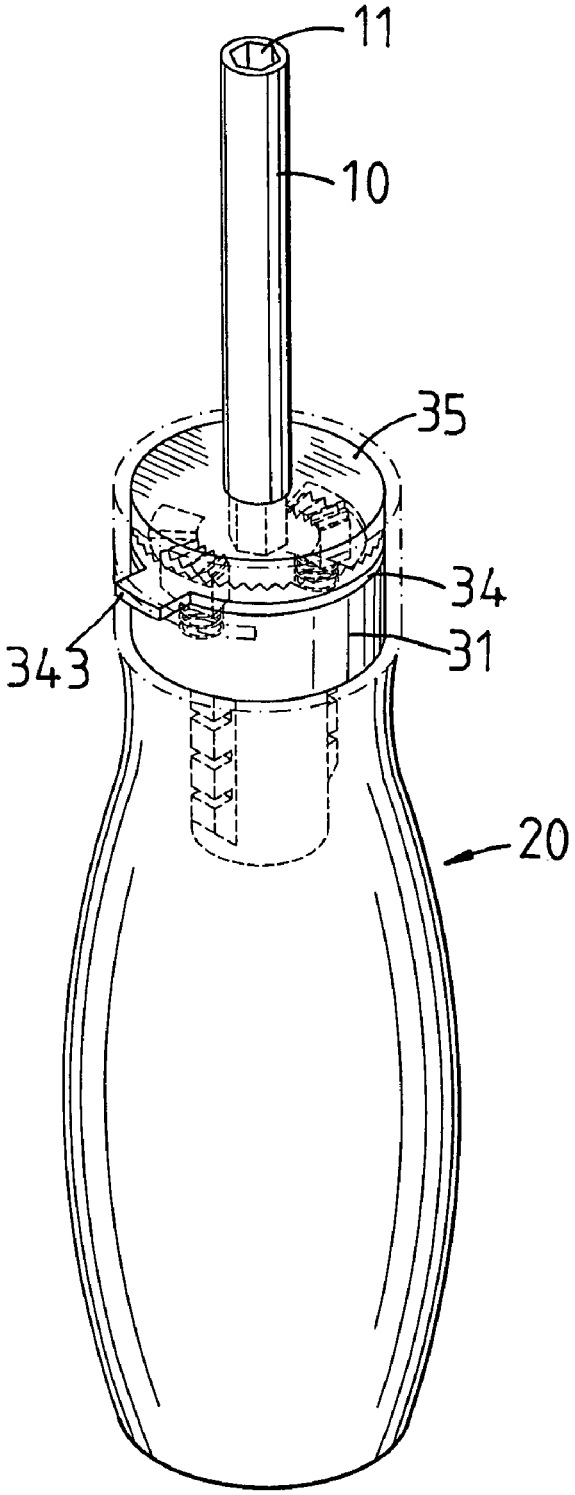
FIG. 3 is a perspective view of the ratchet opener of the present invention.

Referring to FIGS. 1 to 3, the ratchet opener of the present invention is illustrated. The ratchet opener of the present invention includes a round rod body 10. A lower end of the rod body 10 is formed as a hexagonal cylinder. A top of the rod body 10 is formed with a hole 11.

A handle 20 is formed with a receiving chamber 21. Each of two ends of the receiving chamber 21 is formed with respective buckling slot 22, respectively.

A ratchet device includes a seat 31. A center of the seat 31 is formed with a first via hole 311. A lower end of the ratchet device 31 has a protrusion portion 313 for buckling to the buckling slots 22. A top of the ratchet device has two axial grooves 312. Each groove 312 is installed with a spring 32 and a ratchet block 33. An adjusting sheet 34 is placed upon the ratchet blocks 33. A ratchet sheet 35 is placed upon the adjusting sheet 34.

The ratchet teeth 331 of each ratchet block 33 are formed on an inclined surface. The two ratchet blocks 33 are oppositely arranged so as to drive the ratchet sheet 35 to rotate along two different directions. The adjusting sheet 34 is formed with two through holes 341 which are arranged corresponding to the ratchet blocks 33. A center of the adjusting sheet 34 is formed with a second via hole 342. A periphery of the adjusting sheet 34 is formed with a projection 343. Moreover, the ratchet sheet 35 is installed with a hexagonal buckling hole 351 corresponding to the lower end of the rod body 10.

A sleeve 40 has a round hole 41 at a center thereof. A periphery of the sleeve 40 is formed with a radial cambered recess 42. After assembly, the projection 343 of the adjusting sheet 34 will protrude out of the cambered recess 42 so as to control the rotation direction of the ratchet opener.

In assembly of above mentioned structure, the groove 312 of the seat 31 will receive the spring 32 and the ratchet block 33. Then the adjusting sheet 34 and ratchet sheet 35 are located above the ratchet block 33. Then the rod body 10 passes through the buckling hole 351, the second via hole 342 and the first via hole 311. Then the C ring 50 serves to fix the rod body 10 to the ratchet device. After fixing the rod body 10, a lower end of the seat 31 is buckled in the receiving chamber 21 of the handle 20. Finally, the sleeve 40 encloses an upper end of the seat 31 and the projection 343 of the adjusting sheet 34 protrudes out from the cambered recess 42 of the sleeve 40.

Figure 4:
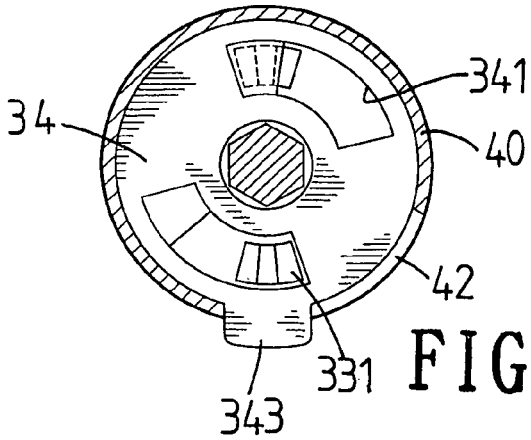
FIG. 4 is an upper cross section view showing the first operation of the ratchet opener of the present invention.
Figure 6:
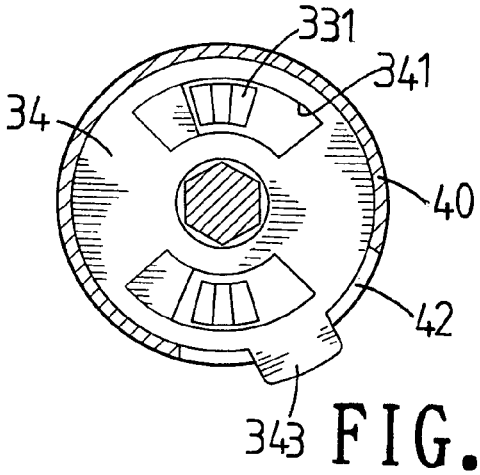
FIG. 6 is an upper cross section view showing the third operation of the ratchet opener of the present invention.
Figure 5:
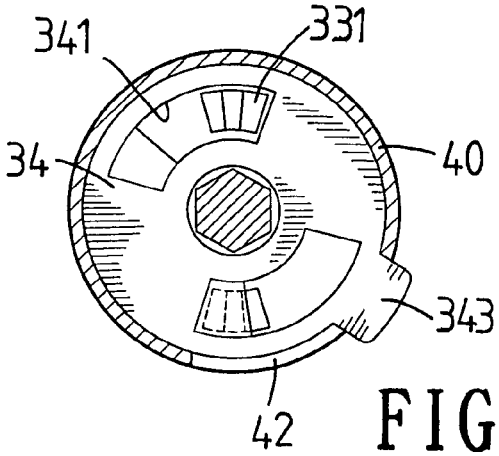
FIG. 5 is an upper cross section view showing the second operation of the ratchet opener of the present invention.
Figure 7:
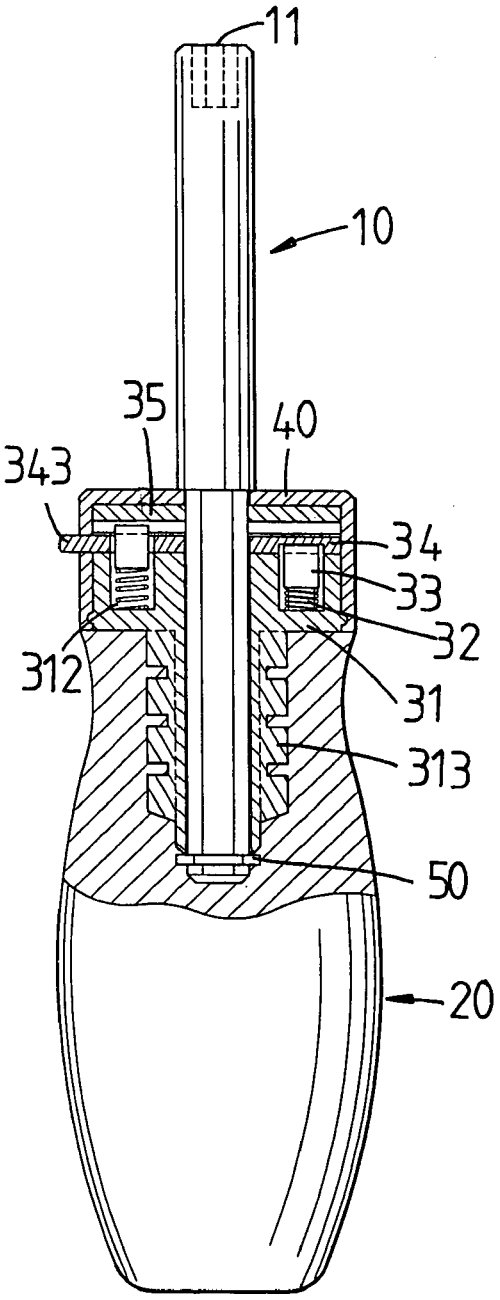
FIG. 7 is a partial cross section view showing the first operation of the ratchet opener of the present invention.
Figure 8:
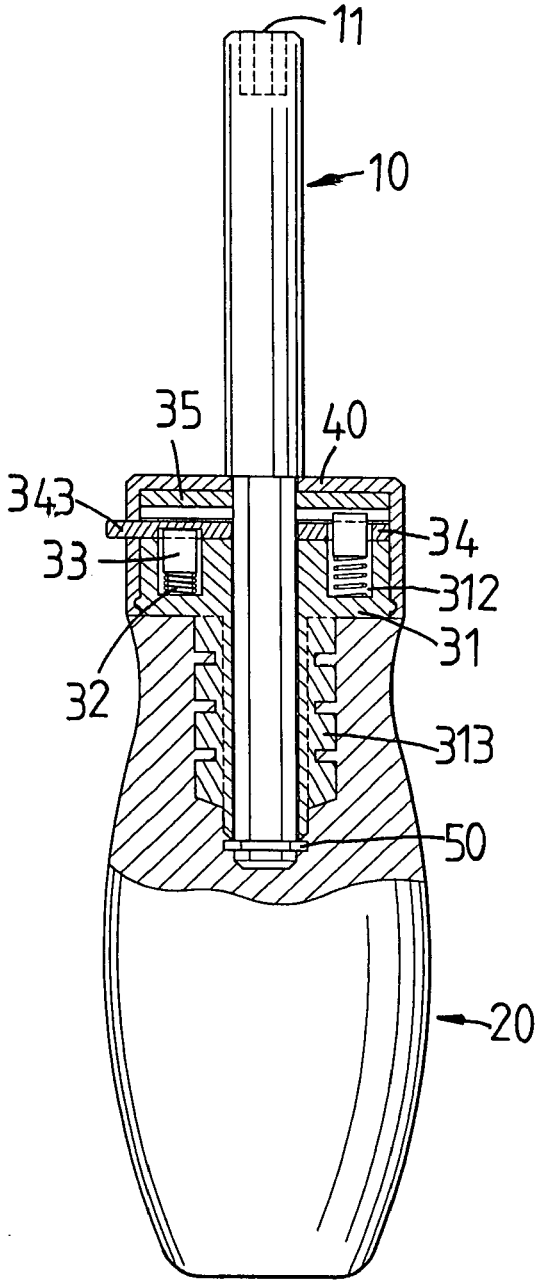
FIG. 8 is a partial cross section view showing the second operation of the ratchet opener of the present invention.
Figure 9:
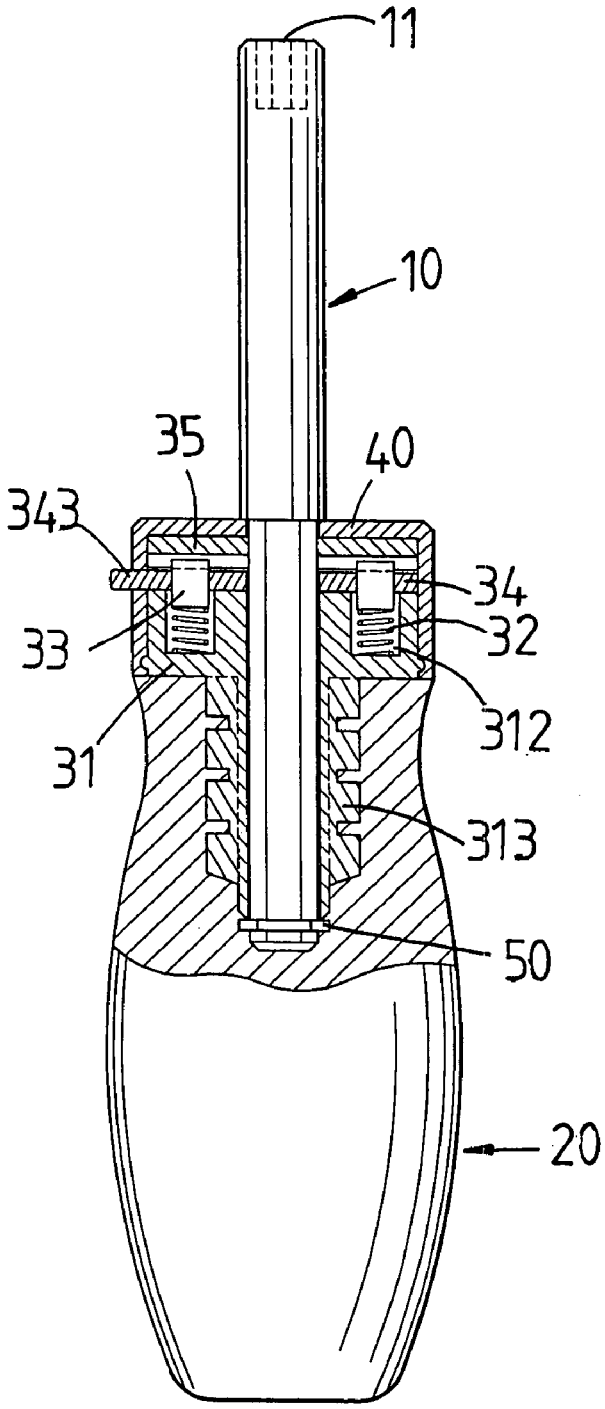
FIG. 9 is a partial cross section view showing the third operation of the ratchet opener of the present invention.

By the above ratchet device, when only one ratchet block 33 protrudes from the through hole 341 to be engaged with the ratchet sheet 35 (referring to FIGS. 4 and 7), since the ratchet block 33 is an unidirectional teethed block, the ratchet opener can only drive the ratchet sheet 35 so as to drive the rod body 10 to rotate unidirectionally. If the other ratchet opener rotates along a reverse direction, the ratchet sheet 35 cannot be driven so as to rotate idly. When the adjusting sheet 34 is adjusted, the ratchet block 33 protrudes out of the through hole 341 to buckle the ratchet sheet 35 (referring to FIGS. 5 and 8). Thus, a completely different action is presented. It causes the ratchet opener to drive the ratchet block 33 to rotate unidirectionally. Similarly, when the two ratchet blocks 33 are buckled to the ratchet sheet 35 simultaneously (referring to FIGS. 6 to 9), the ratchet opener will drive the ratchet sheet 35 to achieve the object of bi-directional rotation.

In use, by controlling the adjusting sheet 34, the objects of unidirectional, bi-directional, and idle rotations are achieved. The operation is easy. The assembly work is easy and convenient and the structure is simple. Thereby, the difficulty in manufacturing is reduced.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A ratchet opener comprising:

a rod body; a lower end of the rod body being protruded with a non-round cylinder;

a handle having a receiving chamber;

a ratchet device having a seat; a center of the seat being installed with a first via hole; a top surface of the seat having two axial grooves; each groove being installed with a spring and a ratchet block; an adjusting sheet placed above the seat; and a ratchet sheet being installed above the adjusting sheet;

wherein each ratchet block has a teethed inclined surface; the teethed inclined surfaces of the two ratchet blocks are symmetrical to a center of the seal; the adjusting sheet has two through holes which are arranged corresponding to the two ratchet blocks in the seat; a center of the adjusting sheet is installed with a second via hole; and the ratchet block is installed with a non-round buckling hole corresponding to the cylinder at the lower end of the rod body;

wherein when the ratchet device is assembled, the rod body will pass through the buckling hole and the first via hole and the second via hole and the seat are buckled to the receiving chamber of the handle.

2. The ratchet opener as claimed in claim 1, further comprising a sleeve enclosing the ratchet device.

3. The ratchet opener as claimed in claim 1, wherein a lower end of the seat is formed with a protrusion portion; and the receiving chamber of the handle has buckling slots for buckling the protrusion portion of the seat.

4. The ratchet opener as claimed in claim 1, wherein a C ring serves to fix the rod body to the ratchet device.

5. The ratchet opener as claimed in claim 1, wherein a top of the rod body is formed with a hole for installing an opener head.

6. The ratchet opener as claimed in claim 1, wherein the cylinder at the lower end of the rod body has a hexagonal shape.

* * * * *